US011044936B2

(12) United States Patent
Zuchuat et al.

(10) Patent No.: US 11,044,936 B2
(45) Date of Patent: Jun. 29, 2021

(54) METHOD OF MAKING TOBACCO CUT FILLER

(71) Applicant: PHILIP MORRIS PRODUCTS S.A., Neuchatel (CH)

(72) Inventors: Fabien Zuchuat, Sion (CH); Otto Virag, Marin-Epagnier (CH)

(73) Assignee: Philip Morris Products S.A., Neuchatel (CH)

( * ) Notice: Subject to any disclaimer, the term of this patent is extended or adjusted under 35 U.S.C. 154(b) by 34 days.

(21) Appl. No.: 15/572,008

(22) PCT Filed: May 27, 2016

(86) PCT No.: PCT/EP2016/062008
§ 371 (c)(1),
(2) Date: Nov. 6, 2017

(87) PCT Pub. No.: WO2016/193147
PCT Pub. Date: Dec. 8, 2016

(65) Prior Publication Data

US 2018/0116274 A1 May 3, 2018

(30) Foreign Application Priority Data

May 29, 2015 (EP) ..... 15169992

(51) Int. Cl.
*A24B 13/00* (2006.01)
*A24B 5/16* (2006.01)
*A24B 15/12* (2006.01)

(52) U.S. Cl.
CPC ..... *A24B 13/00* (2013.01); *A24B 5/16* (2013.01); *A24B 15/12* (2013.01)

(58) Field of Classification Search
CPC ..... A24B 13/00; A24B 13/02; A24B 5/16; A24B 7/00; A24B 7/02; A24B 7/04; A24B 7/06; A24B 7/08; A24B 7/10; A24B 7/12; A24B 7/14; A24B 15/12
See application file for complete search history.

(56) References Cited

U.S. PATENT DOCUMENTS 3,769,866 A * 11/1973 Pietrucci ..... A24B 7/06 83/302
4,497,331 A 2/1985 Nellen
5,445,054 A 8/1995 Pryor
(Continued)

FOREIGN PATENT DOCUMENTS

CN 101828762 9/2010
CN 102178337 9/2011
(Continued)

OTHER PUBLICATIONS

Office Action issued in Kazakhstan for Application No. 2017/1143.1 dated Jul. 31, 2018 (5 pages). English translation included.
(Continued)

*Primary Examiner* — Joseph S Del Sole
*Assistant Examiner* — Jamel M Nelson
(74) *Attorney, Agent, or Firm* — Mueting Raasch Group

(57) ABSTRACT

A tobacco cut filler comprises a first tobacco material cut in accordance with a first cut specification, wherein the first cut specification sets at least predetermined first cut width and first cut length.

21 Claims, 2 Drawing Sheets

(56) References Cited

U.S. PATENT DOCUMENTS

| | | | | |
|---|---|---|---|---|
| 5,813,413 | A | 9/1998 | Metzner | |
| 8,852,350 | B2 | 10/2014 | Sampson | |
| 9,210,951 | B2 | 12/2015 | Borst | |
| 2007/0084476 | A1* | 4/2007 | Yang | A24B 3/14 131/372 |
| 2011/0315153 | A1 | 12/2011 | Fiebelkorn | |
| 2014/0137882 | A1* | 5/2014 | De Borst | A24B 5/16 131/352 |
| 2014/0311501 | A1* | 10/2014 | Hoffman | A24B 5/08 131/300 |
| 2015/0096576 | A1 | 4/2015 | Gao | |

FOREIGN PATENT DOCUMENTS

| | | | | |
|---|---|---|---|---|
| CN | 203087506 | | 7/2013 | |
| CN | 103338660 | | 10/2013 | |
| EA | 8790 | | 8/2007 | |
| EP | 0651951 | | 5/1995 | |
| EP | 0651951 | B1 * | 10/2001 | A24B 3/08 |
| EP | 2783587 | | 10/2014 | |
| GB | 2131671 | | 6/1984 | |
| JP | S52-120199 | | 10/1977 | |
| JP | H07-184624 | | 7/1995 | |
| JP | H07-265043 | | 10/1995 | |
| JP | 2014-500034 | | 1/2014 | |
| JP | 2014-500035 | | 1/2014 | |
| RU | 2542548 | | 4/2013 | |
| RU | 2013/134261 | | 1/2015 | |
| RU | 2573296 | | 1/2016 | |
| WO | WO 94/10864 | | 5/1994 | |
| WO | WO 2012/085199 | | 6/2012 | |
| WO | WO 2012/085201 | | 6/2012 | |
| WO | WO 2015/007400 | | 1/2015 | |
| WO | WO 2015/063174 | | 5/2015 | |

OTHER PUBLICATIONS

European Extended Search Report for Application No. 15169992.3 dated Mar. 7, 2016 (9 pages).
International Search Report and Written Opinion for PCT/EP2016/062008 dated Jun. 14, 2016 (11 pages).
International Preliminary Report on Patentability for PCT/EP2016/062008 dated Aug. 18, 2017 (13 pages).
Office Action issued in Kazakhstan for Application No. 2017/1143.1 dated Nov. 8, 2018 (9 pages). English translation included.
Office Action issued in Singapore for Application No. 11201708924U dated Dec. 13, 2018 (13 pages).
Office Action issued in Russia for Application No. 2017135230 dated Aug. 20, 2019 (16 pages). English translation included.
Office Action issued in China for Application No. 201680028351.0 dated Dec. 3, 2019 (21 pages). English translation included.
Office Action issued in Japan for Application No. 2017-559641 dated Jun. 22, 2020 (7 pages). English translation included.

* cited by examiner

METHOD OF MAKING TOBACCO CUT FILLER

This application is a U.S. National Stage Application of International Application No. PCT/EP2016/062008, filed May 27, 2016, which was published in English on Dec. 8, 2016, as International Publication No. WO 2016/193147 A1. International Application No. PCT/EP2016/062008 claims priority to European Application No. 15169992.3 dated May 29, 2015.

The present invention relates to the production of tobacco cut filler comprising reconstituted tobacco and to a smoking article formed from a tobacco rod comprising the cut filler according to the invention.

Conventionally, cut filler tobacco products for smoking articles are formed predominantly from the lamina portion of the tobacco leaf, which is separated from the stem portion of the leaf during a threshing process. Much of the stem portion that remains after the lamina has been removed and separated is not used. However, it is not uncommon to add some tobacco stems back into the cut filler together with the lamina. By way of example, it is known to provide tobacco cut filler comprising cut rolled stems having a predetermined rolled thickness and cut to a predetermined width. In order to improve the taste and burning characteristics of the tobacco stem for use in the cut filler, the stems are often first subjected to one or more treatment procedures. In addition, or as an alternative, it is known to combine a reconstituted tobacco material with the lamina. Reconstituted tobacco is formed from tobacco material such as tobacco stems, tobacco stalks, leaf scraps and tobacco dust, which are produced during the manufacturing processes of tobacco products. Such tobacco material may, for example, be ground to a fine powder and then mixed with water and typically with a binder, such as guar gum, to form a slurry. This slurry is then cast onto a supportive surface, such as a belt conveyor, and dried to form a sheet (so called 'cast leaf') that can be removed from the supportive surface and wound into bobbins. Alternative methods for the manufacture of reconstituted tobacco sheets are also known to the skilled person.

In a conventional process, reconstituted tobacco or tobacco stem material or both are typically blended with threshed tobacco lamina to undergo a series of treatments, such as conditioning and drying. To this purpose, a reconstituted tobacco sheet is typically ripped into randomly shaped sheet-like pieces having a non-uniform size, generally of several square centimetres. These irregular pieces are intended to be similar in size to tobacco lamina, such that they can be blended with the tobacco lamina and cut. In particular, the blend is typically cut into particles having a predetermined cut width. However, because the reconstituted tobacco sheet is rather randomly ripped into pieces, the tobacco fibres are generally not aligned in a uniform direction.

Because of the reduced tobacco fibre length within the reconstituted tobacco material, exposure to the same treatments as tobacco lamina may degrade, to some extent, the reconstituted tobacco. By way of example, during drying, the moisture content of reconstituted tobacco is greatly reduced, resulting in shrinkage of the tobacco particles forming the reconstituted tobacco sheet. Additionally, the cutting techniques generally employed to convert the tobacco material blend into filler may result in some lamination and compression of the reconstituted tobacco material. All this causes a reduction in the filling power of the treated reconstituted tobacco and, accordingly, of the tobacco cut filler as a whole.

Further, when reconstituted tobacco undergoes the same treatments as tobacco lamina, a significant amount of tobacco dust is formed. This is undesirable because such tobacco dust needs to be collected. Besides, in the interest of process economy, it is desirable that the tobacco dust be reprocessed in some form or other to increase the overall efficiency.

It would therefore be desirable to provide an alternative tobacco cut filler having improved filling power. At the same time, it would be desirable to provide a novel process for manufacturing tobacco cut filler, whereby the filling power of the tobacco cut filler is improved and the production of tobacco dust is reduced.

Further, it would be desirable to provide one such improved process that allows for a better control of the shape, size and properties of the reconstituted tobacco matter forming part of the cut filler. At the same time, it would be desirable to provide one such process that does not require any major modification of the conventional apparatus and facilities used in the primary treatment of tobacco.

According to an aspect of the present invention, there is provided a tobacco cut filler comprising a first tobacco material cut in accordance with a first cut specification, wherein the first cut specification sets at least predetermined first cut width and first cut length.

According to a further aspect of the present invention, there is provided a method of making tobacco cut filler comprising providing a first tobacco material and cutting the first tobacco material in accordance with a first cut specification setting at least predetermined first cut width and first cut length.

It shall be appreciated that any features described with reference to one aspect of the present invention are equally applicable to any other aspect of the invention.

In contrast to known cut fillers, in accordance with the present invention a tobacco cut filler is formed by cutting a first tobacco material in accordance with a cut specification that sets at least both cut width and cut length of the particles of first tobacco material ending in the tobacco cut filler corresponding to a final cut width and a final cut length in the tobacco cut filler when used in a tobacco product.

Because the first tobacco material undergoes a cutting or shredding operation in accordance with a dedicated cut specification that sets not just the cut width, but also the cut length, it is possible to accurately tailor the characteristics of the resulting cut filler particles independently of the characteristics of any possible further component of the cut filler. In addition, the cut width and cut length imparted to the first tobacco material during the cut operation in accordance with the first cut specification are not altered by any subsequent operation that the first tobacco material may be subjected to, and so the first cut width and first cut length set by the first cut specification correspond to the final cut width and final cut width that the first tobacco material has in the cut filler when it is ultimately used in a tobacco product. By finely controlling the size and shape of the strips into which the first tobacco material is cut or shredded, the features of the first tobacco material can advantageously be better preserved whenever the first tobacco material is blended, in the shredded state, with any other tobacco material. This is particularly advantageous when the first tobacco material is a pre-processed tobacco material, such as a reconstituted tobacco sheet material.

Further, the filling power of the shredded first tobacco material can be maximised by selecting a suitable first cut specification. This results in an improved filling power of the cut filler as a whole, particularly when the first tobacco material is blended with at least another tobacco material. In addition, the formation of tobacco dust is reduced compared with traditional manufacturing methods. Accordingly, the need to collect and re-process tobacco dust is significantly reduced and the overall efficiency of the manufacturing process is thus advantageously increased.

The term "cut specification" is used throughout the specification to refer to the various geometric parameters characterising the strips obtained by subjecting a tobacco material to a cutting operation. Thus, in accordance to a given "cut specification", a tobacco material shall be cut or shredded into strips having a predetermined cut width, cut length, cut shape and so forth.

The "cut length" of a strip of cut tobacco material for incorporation in cut fillers according to the present invention refers to the maximum dimension of the strip of the tobacco material resulting from the cutting operation, that is the maximum measurable distance between two points on the cut strip. When looking at a cut strip under a microscope, it will generally be possible to observe the direction along which the cut strip extends over such greater length (that is, the longitudinal direction).

The expressions "final cut width" and "final cut length" are used herein to describe the cut width and cut length of a tobacco material as found in a tobacco cut filler used in a tobacco product. In practice, although the tobacco material may be blended with one or more other components of the cut filler, the cut width and cut length set by the cut specification are not altered in any way during any subsequent operation, regardless of these operations being carried out on the tobacco material alone or on a blend of the tobacco material with one or more other tobacco materials.

By way of example, if a sheet of reconstituted tobacco is cut according the invention to a first cut specification setting a cut width and a cut length, the reconstituted tobacco being used as a component of tobacco cut filler in the tobacco rod of a smoking article, the particles of reconstituted tobacco in the tobacco rod have substantially the same (final) cut width and (final) cut length as set by the cut specification.

Typically, prior to being cut, a tobacco material may undergo other mechanical operations, such as rolling or extrusion. Without wishing to be bound to theory, it will be appreciated that during any cutting, rolling or extruding operation, the tobacco fibres generally align in a given direction, which may thus be identified as the longitudinal direction of the tobacco material. The "cut length" of a cut strip of tobacco material for incorporation in cut fillers according to the present invention may therefore be measured along the main direction of fibre alignment, which generally corresponds to the longitudinal direction. Thus, the cut length of an individual cut strip can be accurately measured using a conventional measuring device under a microscope.

The "cut width" of a cut strip of tobacco material for incorporation in cut fillers according to the present invention refers to the maximum dimension of the strip of tobacco material resulting from the cutting operation measured in a direction substantially perpendicular to the longitudinal direction of the particle. Thus, the cut width of an individual cut strip is taken at the point along the length of the strip that yields the largest cross-sectional area.

In general, regardless of its overall shape, it is possible to identify within any one cut strip of tobacco material one or more strip portions extending in a substantially straight direction, that is, it is possible to identify one or more strip portions having a substantially rectangular, ribbon-like shape. The term "sectional cut width" is used in the present specification to describe the side-to-side width of one such portion of a cut strip of tobacco material.

By way of example, in a Y-shaped strip (see, for reference, FIG. 3) it is possible to identify a first strip portion extending along a first direction and a second and third strip portions extending from the first strip portions along diverging directions, so that they form an angle. The cut width of one such Y-shaped strip corresponds substantially to the distance between the ends of the second and third strip portions as measured along a direction perpendicular to the direction defined by an axis of the first strip portion. Within the same Y-shaped strip, the sectional cut width of each strip portion may instead be measured along a direction substantially perpendicular to the axis of each strip portion. In some cases, such as where the cut strip of tobacco material is substantially rectangular (see, for reference, FIGS. 7 and 8), the sectional cut width and the strip cut width are the same. Within a cut strip of tobacco material, the sectional cut width may be the substantially same for all the strip portions. While this can be preferable, the sectional cut width may also vary from one strip portion to another.

The "thickness" of a cut strip of tobacco material for incorporation in cut fillers according to the present invention refers to the distance between an upper surface and a lower surface of the portion of material forming the cut strip. The thickness therefore corresponds substantially to the thickness of the tobacco material (such as tobacco lamina, or tobacco stem material, or a tobacco sheet material) fed to the cutting or shredding apparatus. The thickness of an individual cut strip can be measured using a conventional measuring device under a microscope. In some embodiments, the thickness of a tobacco material forming the cut strip may be substantially constant. In other embodiments, the thickness of the tobacco material forming the cut strip may vary along the longitudinal direction, along a direction perpendicular to the longitudinal direction, or along both. The thickness of an individual cut strip is measured at the point along the longitudinal direction of cutting that yields the largest cross-sectional area.

The term "sinusoidal" is used to describe a cut strip of tobacco material shaped substantially like a portion of a sine wave. In practice, one such cut strip may be described as approximately wave-shaped or zigzag-shaped. Accordingly, geometric parameters corresponding to the peak amplitude, peak-to-peak amplitude, period (or wave length) of a sine wave may be used to describe the shape of one such cut strips.

Throughout this specification, the expression "reconstituted tobacco sheet" is used to refer to a web, preferably with substantially uniform thickness, that may be produced by the rolling or casting of an aqueous slurry or pulp formed from tobacco particles by one of several methods known in the art. Suitable by-products include tobacco stems, tobacco stalks, leaf scraps, and tobacco dust produced during the manufacturing process. By way of example, tobacco stems may be ground to a fine powder and then mixed with tobacco dust, guar gum, and water to form an aqueous slurry. This aqueous slurry may be cast and dried to form a reconstituted tobacco sheet. As an alternative, suitable tobacco materials may be mixed in an agitated tank with water to obtain a pulp. This web is fed onwards to a press, where the excess water is squeezed out of the web. Finally, the pressed web is dried.

The term "filling power" is used to describe the volume of space taken up by a given weight or mass of a tobacco material. The greater the filling power of a tobacco material, the lower the weight of the material required to fill a tobacco rod of standard dimensions. The values of filling power are expressed in terms of corrected cylinder volume (CCV) which is the cylinder volume (CV) of the tobacco material at a reference moisture level of 12.5 percent oven volatiles. The cylinder volume (CV) may be determined using a Borgwaldt densimeter DD60 or DD60A type fitted with a measuring head for cut tobacco and a tobacco cylinder container.

In a suitable method for determining the value of CCV, a sample of the cut filler is placed in the tobacco cylinder container of the Borgwaldt densimeter and subjected to a load of 2 kg for 30 seconds. The height of the sample after the loading time has expired is measured and this is converted to a cylinder volume using the formula:

$$CV = \frac{r^2 \cdot h \cdot \pi}{SW \cdot 10}$$

where r is the cylinder radius (3.00 cm for the densimeter indicated above), h is the height of the sample after the loading time has expired and SW is the weight of the sample. The measured CV is then converted to a corrected value of CCV at the reference moisture level value (ROV) of 12.5 percent oven volatiles, using the formula:

$$CCV=(OV-ROV)\cdot f+CV$$

where OV is the actual percent oven volatiles of the sample of tobacco cut filler and f is a correction factor (0.4 for the test indicated).

The moisture content of the tobacco cut filler is expressed herein as "percent oven volatiles", which is determined by measuring the percentage weight loss from the cut filler upon drying the material in an oven at 103 degrees Centigrade (° C.) for 100 minutes. It is assumed that a significant majority of the weight loss from the cut filler results from the evaporation of moisture.

A tobacco cut filler according to the present invention comprises a first tobacco material cut in accordance with a first cut specification, wherein the first cut specification sets at least predetermined first cut width and first cut length.

Preferably, the tobacco cut filler further comprises a second tobacco material cut in accordance with a second cut specification differing from the first cut specification for at least one of cut length and cut width.

In preferred embodiments, the first tobacco material is a pre-processed tobacco material. By "pre-processed tobacco material" reference is made throughout the specification to a tobacco material produced by man from natural tobacco as opposed to occurring naturally as such. Preferably, the first tobacco material is a reconstituted tobacco sheet.

Preferably, the second tobacco material is a natural tobacco leaf material. Suitable natural tobacco leaf materials include tobacco lamina, tobacco stem material and tobacco stalk material. The natural tobacco leaf material used as the second tobacco material may include any type of tobacco leaf, including for example Virginia tobacco leaf, Burley tobacco leaf, Oriental tobacco leaf, flue-cured tobacco leaf, or a combination thereof.

Preferably, the first tobacco material is shredded into strips wherein the cut length is greater than the cut width.

Preferably, the first tobacco material is shredded into strips having a cut length of at least about 5 mm. More preferably, the first tobacco material is shredded into strips having a cut length of at least about 10 mm. Even more preferably, first tobacco material is shredded into strips having a cut length of at least about 15 mm. In addition, or as an alternative, the first tobacco material is preferably shredded into strips having a cut length of less than about 60 mm. More preferably, the first tobacco material is shredded into strips having a cut length of less than about 50 mm. Even more preferably, the first tobacco material is shredded into strips having a cut length of less than about 40 mm. In preferred embodiments, the first tobacco material is shredded into strips having a cut length from about 5 mm to about 60 mm.

In some embodiment, the cut length distribution among the cut strips of the first tobacco material is preferably unimodal. In other embodiments, the cut length distribution among the cut strips of the first tobacco material may be multimodal, including in particular bimodal and trimodal.

In statistics, a unimodal distribution is a distribution which has a single mode. In a discrete probability distribution—as is the case with the distribution of cut length or cut width values in a population of particles of the first tobacco material—the mode is a value at which the probability mass function takes its maximum value. In other words, in the present specification, the mode of a unimodal distribution will identify a most likely value of cut width or cut length in a population of particles of the tobacco material. In practice, if the amount of particles having a certain cut length or cut width is plotted against the increasing cut length or cut width, the chart of the amount of particles will typically have a single maximum.

If a distribution has two or more modes, it is generally referred to as multimodal. Particular examples are bimodal and trimodal distributions, which have two and three modes, respectively. Preferably, the first tobacco material is shredded into strips having a cut width of at least about 0.2 mm. More preferably, the first tobacco material is shredded into strips having a cut width of at least about 0.25 mm. Even more preferably, the first tobacco material is shredded into strips having a cut width of at least about 0.3 mm. In addition, or as an alternative, the first tobacco material is preferably shredded into strips having a cut width of less than about 1 mm. More preferably, the first tobacco material is shredded into strips having a cut width of less than about 0.95 mm. Even more preferably, the first tobacco material is shredded into strips having a cut width of less than about 0.9 mm. In preferred embodiments, the first tobacco material is shredded into strips having a cut width from about 0.2 mm to about 1 mm.

In some embodiment, the cut width distribution among the cut strips of the first tobacco material is preferably unimodal. In other embodiments, the cut width distribution among the cut strips of the first tobacco material may be multimodal, including in particular bimodal and trimodal.

A mode of a discrete probability distribution, as is the case with the cut length (or cut width) distribution among the cut strips of the first tobacco material is a value at which the probability mass function takes a maximum value. Thus, in a unimodal distribution, the probability mass function only has one maximum value, and that corresponds to the most likely value of cut length (or cut width). By contrast, in a multimodal distribution, the probability mass function has multiple maxima, which means that among the cut strips of the first tobacco material there are multiple values of cut length (or cut width) that occur most often. In the context of the present specification, a distribution having multiple local maxima is regarded as multimodal. It will be appreciated that the different modes (or peaks) in a multimodal distribution may also have different frequencies, such that, among the cut strips of the first tobacco material, one modal value of cut length (or cut width) will occur more frequently than another modal value. For example, a bimodal distribution may correspond effectively to two groups of cut strips having different average cut lengths (or cut widths), one group being larger than the other. Preferably, the first tobacco material is shredded into strips from a sheet material having a thickness of at least about 0.05 mm. More preferably, the first tobacco material is shredded into strips from a sheet material having a thickness of at least about 0.1 mm. Even more preferably, the first tobacco material is shredded into strips from a sheet material having a thickness of at least about 0.2 mm. In addition, or as an alternative, the first tobacco material is preferably shredded into strips from a sheet material having a thickness of less than about 1 mm. More preferably, the first tobacco material is shredded into strips from a sheet material having a thickness of less than about 0.95 mm. Even more preferably, the first tobacco material is shredded into strips from a sheet material having a thickness of less than about 0.85 mm. In preferred embodiments, the first tobacco material is shredded into strips from a sheet material having a thickness from about 0.05 mm to about 1 mm. Even more preferably, the first tobacco material is shredded into strips from a sheet material having a thickness from about 0.1 mm to about 0.3 mm, most preferably from a sheet material having a thickness of about 0.2 mm.

The first tobacco material may be cut into strips having any suitable shape, including rectangular, trapezoidal, sinusoidal, Y-shaped, X-shaped and V-shaped.

FIGS. 1-12 depict several examples of particularly shapes into which tobacco material for forming a cut filler in accordance with the present invention may be cut.

FIGS. 1 and 2 illustrate sinusoidal strips. In more detail, FIG. 1 shows a zigzag-shaped strip and FIG. 2 shows a wave-shaped strip. Where the cut strip is zigzag-shaped or wave-shaped, it is possible to measure a wave length of the cut strip, which substantially corresponds to the strip cut length divided by the number of repetitions of the zigzag or wave. For instance, in the cut strip of FIG. 1 the zigzag is repeated 10 times. In the cut strip of FIG. 2 the wave is repeated 6 times. Preferably, a wave length of the sinusoidal shape is from about 1 mm to about 15 mm, more preferably from about 2 mm to about 12 mm, even more preferably from 4 mm to 10 mm.

Figure 6:
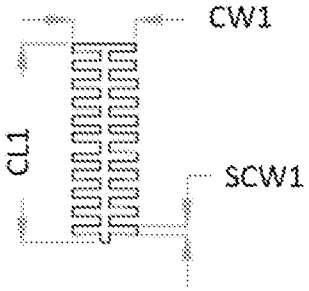

A fishbone-shaped strip is shown in FIG. 6, whereas

Figure 7:
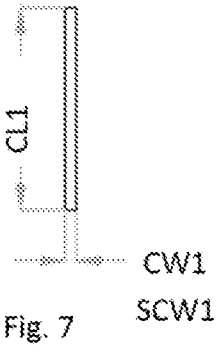
Figure 8:
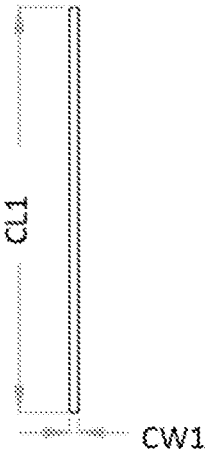

FIGS. 7 and 8 show two embodiments of rectangular strips.

Figure 9:
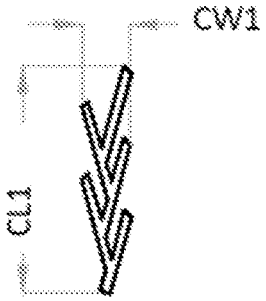
Figure 11:
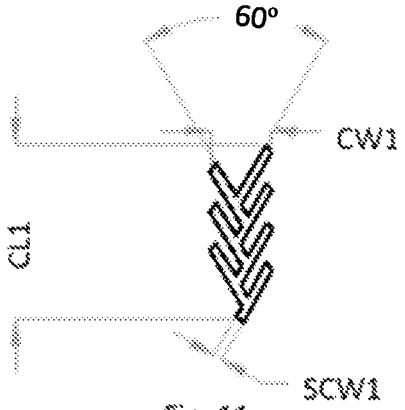

FIGS. 9 and 11 illustrate two examples of strips having a more complex, "hybrid" shape, wherein strip structures having the same or different shape substantially branch off one another. In particular, one such strip may comprise at least a first strip structure comprising a branching node from which a further strip structure branches off, forming an angle with the first strip structure.

Preferably, in a cut filler according to the present invention, the first tobacco material is shredded into cut strips comprising at least a first, a second and a third strip structures, wherein the first strip structure comprises a node from which the second strip structure branches off, the second strip structure comprises a second node from which the third strip structure branches off.

By way of example, the cut strip of FIG. 9 comprises a first Y-shaped structure including a first branching node from which a second Y-shaped structure branches off. Further, the second Y-shaped structure comprises a second branching node from which a rectangular structure branches off. In the embodiment of FIG. 11, the cut strip comprises a first Y-shaped structure including a first branching node from which a second Y-shaped structure branches off. Further, the second Y-shaped structure comprises a second branching node from which a third Y-shaped structure branches off. In turn, the third Y-shaped structure comprises a third branching node from which a rectangular structure branches off. In the embodiments of both FIGS. 9 and 11 the sectional cut width within all the structures forming the cut strips is substantially constant.

Figure 10:
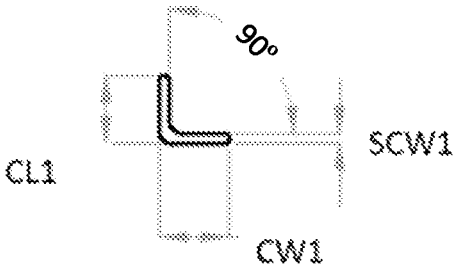
Figure 12:
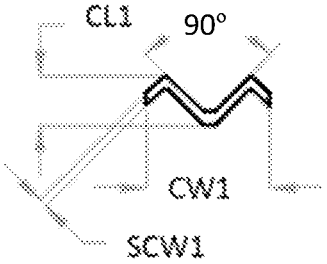

FIGS. 10 and 12 show two examples of cut strips including one or more V-shaped structure. Each V structure comprises two substantially straight elements forming an angle. In the embodiment of FIG. 10, the two straight elements are substantially perpendicular. The cut strip of FIG. 12 may be regarded as comprising three V-shaped structures of the type illustrated in FIG. 1, wherein adjacent V-shaped structures are connected by the ends of respective straight elements. In the embodiments of both FIGS. 10 and 12 the sectional cut width within all the structures forming the cut strips is substantially constant.

Preferably, the cut filler has a filling power of at least about 3.5 cubic centimetres per gram at a reference moisture value of 12.5 percent oven volatiles. More preferably, the cut filler has a filling power of at least about 4 cubic centimetres per gram at a reference moisture value of 12.5 percent oven volatiles. In addition, or as an alternative, the cut filler preferably has a filling power of less than about 8 cubic centimetres per gram at a reference moisture value of 12.5 percent oven volatiles. More preferably, the cut filler has a filling power of less than about 7 cubic centimetres per gram at a reference moisture value of 12.5 percent oven volatiles. In some particularly preferred embodiments, the cut filler has a filling power of from about 3.5 cubic centimetres per gram to about 8 cubic centimetres per gram at a reference moisture value of 12.5 percent oven volatiles.

Tobacco cut filler in accordance with the present invention may be incorporated into a variety of smoking articles. In some embodiments, tobacco cut filler according to the invention may be used in the tobacco rod of a combustible smoking article, such as a filter cigarette, cigarillo or cigar. Alternatively, the cut filler may be used to provide the tobacco aerosol generating substrate in a distillation based smoking article, or an electrically heated smoking system. Alternatively, the cut filler may be used as a roll-your-own or make-your-own product, or loose tobacco product for use in a pipe.

Tobacco cut fillers according to the present invention may be prepared by a method comprising providing a first tobacco material and cutting the first tobacco material in accordance with a first cut specification setting at least predetermined first cut width and first cut length.

Preferably, the method further comprises providing a second tobacco material and cutting the second tobacco material separately from the first tobacco material and in accordance with a second cut specification, the second cut specification differing from the first cut specification for at least one of cut length and cut width. Further, the method preferably comprises the step of blending the cut first tobacco material and the cut second tobacco material. This is particularly advantageous because, since the first tobacco material is cut separately from the second tobacco material and may thus not be exposed to the same operating conditions and treatment steps to which the second tobacco material is subjected, the features of the first tobacco material can effectively be preserved when it is ultimately blended, in a shredded state, with the cut second tobacco material to form the cut filler.

The method may further comprise a step of conditioning the first tobacco material prior to cutting the first tobacco material. Further, the method may comprise a step of controlling the moisture content of the cut filler by adjusting the moisture content of the first tobacco material. In addition or as an alternative, the method may further comprise a step of adjusting the moisture content of the second tobacco material.

Figure 13:
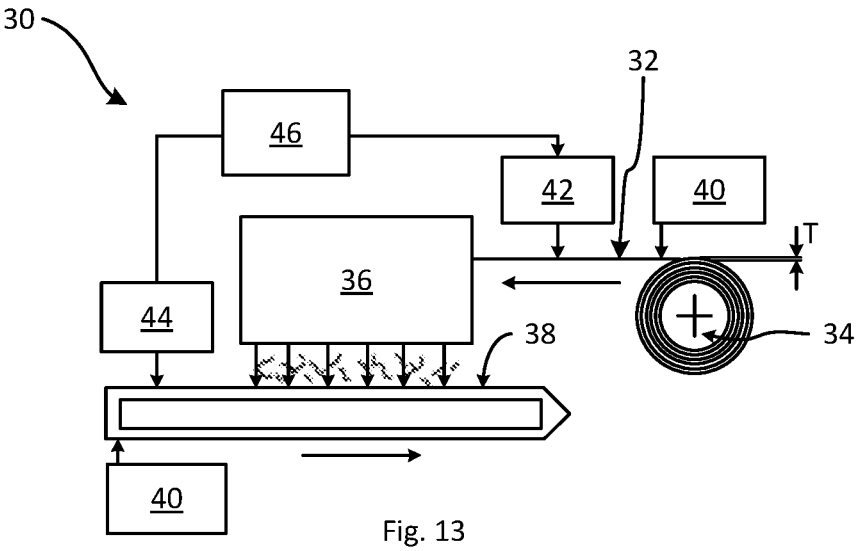

The invention will be further described, by way of example only, with reference to the accompanying drawings in which:

FIGS. 1 to 12 depict schematic top views of cut strips of a tobacco material for forming a tobacco cut filler in accordance with the present invention; and FIG. 13 depicts a schematic view of an apparatus for forming a tobacco cut filler in accordance with the present invention.

FIGS. 1 to 12 shows cut strips of a first tobacco material for incorporation in a cut filler according to the present invention. The strips have been cut from a sheet of reconstituted tobacco having a thickness from about 0.05 mm to about 1 mm in accordance with a first cut specification, wherein the first cut specification sets a predetermined first cut width CW1 and a predetermined first cut length CL1. In addition, the first cut specification may further set a predetermined first sectional cut width SCW1.

FIG. 13 illustrates an apparatus 30 for the manufacture of a tobacco cut filler in accordance with the present invention. A web 32 of reconstituted tobacco having a thickness T is unwound off a bobbin 34 and fed to a shredding device 36. The shredding device is configured to cut the reconstituted tobacco in accordance to a first cut specification, whereby both cut width and cut length are predetermined. The cut strips are dropped onto a conveyor belt 38 arranged beneath the shredding device 36 and defining a collection surface upon which the cut strips fall out of the shredding device. Additional means T may be provided for tensioning the web of reconstituted tobacco as it is unwound off the bobbin. Further, the apparatus 30 may comprise sensors 40 for detecting the moisture content of the web of reconstituted tobacco upstream of the shredding device 36. In addition, the apparatus 30 may comprise mass flow controllers 42, 44 adapted to adjust the speed at which the web of reconstituted tobacco is fed to the shredding device 36 and the speed of the conveyor belt 38. Sensors 40 and mass flow controllers 42, 44, if present, are operatively connected with a control unit 46 configured to control the operation of the apparatus. In particular, the control unit 46 adjusts the speed to the conveyor belt 38 in view of variations in the speed at which the web of reconstituted tobacco is fed to the shredding device 36, so as to prevent any undesirable accumulation of cut strips on the conveyor belt. The cut strips are then advanced to a further station (not shown) wherein they are blended with a second tobacco material cut in accordance with a second cut specification, such that at least one of cut width and cut length of the cut strips of the second tobacco material differs from a corresponding one of cut width and cut length of the cut strips of the first tobacco material.

EXAMPLE 1 BASIC CUT SPECIFICATIONS

Experiments were carried out in order to assess the impact of different shapes and cut specifications to key parameters of tobacco cut filler particles, such as the filling power.

In a first stage, the CCV was measured at a reference moisture value of 12.5 percent oven volatiles for pure samples each containing tobacco particles cut from a sheet of reconstituted tobacco (basis weight: about 150 grams/square metre) in accordance with a predetermined shape and cut specification. The following Table 1 lists the various cut specifications tested. For each sample, reference is made to the corresponding Figure illustrating the shape. In each Figure, CL1 represents the cut length of the particle, CW1 the overall width or the particle, and SCW1 the cut width of the particle. For the rectangular shapes of FIGS. 7 and 8 the overall width of the particle coincides with the cut width of the particle.

TABLE 1

Figure 1:
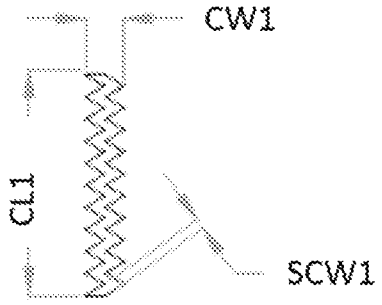
Figure 2:
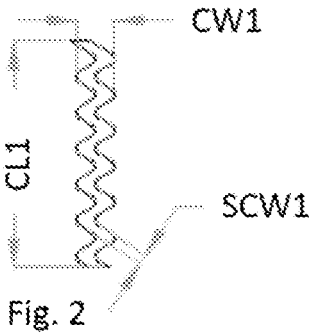
Figure 3:
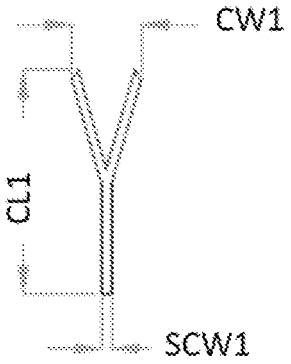
FIG. 3 shows a Y-shaped strip.
Figure 4:
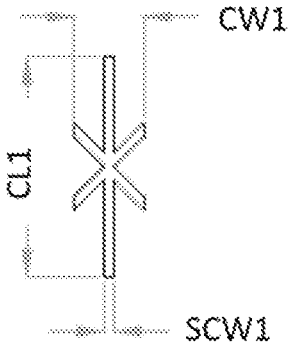
FIG. 4 shows a star-shaped strip.
Figure 5:
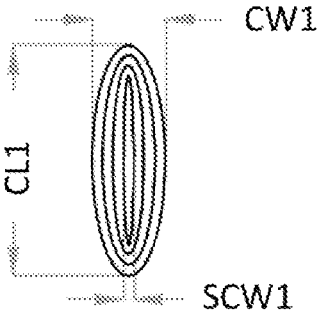
FIG. 5 illustrates an oval shaped strip.

| Cut specification No. | Shape | Length (CL1) | Width (CW1) | Cut width (SCW1) |
|---|---|---|---|---|
| 1 | FIG. 1 | 20 mm | 3.5 mm | 0.9 mm |
| 2 | FIG. 2 | 20 mm | 3.5 mm | 0.9 mm |
| 3 | FIG. 3 | 20 mm | 6.3 mm | 0.9 mm |
| 4 | FIG. 4 | 20 mm | 6.3 mm | 0.9 mm |
| 5 | FIG. 5 | 20 mm | 6.3 mm | 0.9 mm |
| 6 | FIG. 6 | 20 mm | 6.3 mm | 0.9 mm |
| 7 | FIG. 7 | 20 mm | 0.9 mm | 0.9 mm |
| 8 | FIG. 8 | 40 mm | 0.9 mm | 0.9 mm |

Table 2 below lists the values of CCV (expressed in cubic centimetres per gram) measured at a reference moisture value of 12.5 percent oven volatiles for each sample. Before each measurement was taken, tobacco particles cut in accordance with the various cut specifications were stored in a conditioned room for 24 hours. The CCV was measured on 5 samples of 20 g for each specification. For each specification, three measurements (CCV1, CCV2 and CCV3) of the CCV were taken on the five samples, and then the total average was calculated and assumed as the effective CCV of the specification. Between repetitions of the measurements, the samples were prepared by detangling the individual strands, so that any compaction occurred during the previous measurement would have as little influence as possible on the subsequently measured CCV.

TABLE 2

| Cut Specification No. | CCV1 | CCV2 | CCV3 | CCV (Average) |
|---|---|---|---|---|
| 1 | 4.59 | 4.75 | 4.74 | 4.69 |
| 2 | 3.65 | 3.69 | 3.83 | 3.72 |
| 3 | 5.33 | 5.27 | 5.32 | 5.31 |
| 4 | 4.63 | 4.49 | 4.65 | 4.59 |
| 5 | 4.20 | 4.34 | 4.20 | 4.25 |
| 6 | 4.03 | 3.91 | 3.85 | 3.93 |
| 7 | 4.44 | 4.38 | 4.70 | 4.51 |
| 8 | 7.43 | 7.38 | 7.40 | 7.40 |

EXAMPLE 2 HYBRID CUT SPECIFICATIONS

The highest CCV values were obtained for cut specification no. 3, which substantially corresponds to particles having a Y-shape. However, it was found that when particles were produced from the same sheet of reconstituted tobacco according to cut specification no. 3 are produced, a significant fraction of the tobacco material went to waste. Accordingly, two further hybrid cut specifications were tested. These correspond to the shapes illustrated in FIGS. 9 and 10, respectively, for which the values of CCV listed in the following Table 3 were measured.

TABLE 3

| Cut Specification No. | CCV1 | CCV2 | CCV3 | CCV (Average) |
|---|---|---|---|---|
| 9 | 5.09 | 4.79 | 4.99 | 4.96 |
| 10 | 5.18 | 5.12 | 5.16 | 5.15 |

Based on these results, the cut specification no. 10 was identified as the one with the highest CCV and, accordingly, as the most promising for use in a cut filler for the manufacture of a smoking article.

EXAMPLE 3 SMOKING ARTICLES

In a third experiment, the cut specification no. 10 was slightly modified with a view to improving the resistance of the particles to the stresses involved by the cigarette-making process. In particular, there was concern that during the cigarette-making process the tobacco particle would be exposed to high tensions and frictions which might cause particles prepared in accordance with the cut specification no. 10 to break. This may have reduced the benefit coming from the V-shape and shown by the CCV measurements described above.

Accordingly, tobacco particles were prepared from the same sheet of reconstituted tobacco according to the cut specification illustrated in FIG. 12, wherein the cut width SCW1 is of 0.9 millimetres, the cut length CL1 is of 4.94 millimetres and the global width CW1 is of 12.50 millimetres. Should one such particle break at a location in the central V-shaped portion, the two resulting parts of the particles would still be effectively V-shaped.

In addition, the cut specification no. 9 was also slightly modified. Since the CCV measurements appeared to indicate that there is an advantage in terms of filling power coming with V-shaped particles, particles were prepared from a sheet of reconstituted tobacco according to the cut specification illustrated in FIG. 11, wherein the cut width SCW1 is of 0.9 millimetres, the cut length CL1 is of 17.60 millimetres and the global width CW1 is of 6.08 millimetres. An angle of 90 degrees was considered to be undesirable, in that it would lead essentially to a shape quite similar to the shape of FIG. 6, and so an angle of 60 degrees was chosen for the "V" elements.

Tobacco rods were prepared from a tobacco cut filler using tobacco particles cut in accordance with the specifications of FIGS. 11 and 12. In particular, a first couple of blends were used, that contained 85 percent by weight of natural tobacco particles and 15 percent by weight of reconstituted tobacco particles cut in accordance with specifications of FIGS. 11 and 12, respectively. In addition, a second couple of blends was used, that contained 70 percent by weight of natural tobacco particles and 30 percent by weight of reconstituted tobacco particles cut in accordance with the specifications of FIGS. 11 and 12, respectively.

The invention claimed is:

1. A tobacco cut filler comprising a first tobacco material cut into strips in accordance with a first cut specification, wherein the first cut specification sets at least predetermined first cut width and first cut length corresponding to a final cut width and a final cut length in the tobacco cut filler when used in a tobacco product, wherein a cut length distribution among the cut strips of the first tobacco material is at least bimodal.

2. A tobacco cut filler according to claim 1, further comprising a second tobacco material cut in accordance with a second cut specification differing from the first cut specification for at least one of cut length and cut width.

3. A tobacco cut filler according to claim 1, wherein the first tobacco material is a pre-processed tobacco material.

4. A tobacco cut filler according to claim 1, wherein the first tobacco material is a reconstituted tobacco sheet.

5. A tobacco cut filler according to claim 2, wherein the second tobacco material is a natural tobacco leaf material.

6. A tobacco cut filler according to claim 1, wherein the first tobacco material is shredded into strips having a cut length from about 5 mm to about 60 mm.

7. A tobacco cut filler according to claim 1, wherein the cut length distribution among the cut strips of the first tobacco material is trimodal.

8. A tobacco cut filler according to claim 1, wherein the first tobacco material is shredded into strips having a cut width from about 0.2 mm to about 1 mm.

9. A tobacco cut filler according to claim 1, wherein the first tobacco material is shredded into strips from a sheet material having a thickness from about 0.05 mm to about 1 mm.

10. A tobacco cut filler according to claim 1, wherein the first tobacco material is shredded into strips having a sinusoidal shape, wherein a wave length of the sinusoidal shape is from about 1 mm to about 15 mm.

11. A tobacco cut filler according to claim 1, wherein the first tobacco material is shredded into strips each comprising at least a first strip structure comprising a branching node from which a further strip structure branches off, forming an angle with the first strip structure.

12. A tobacco cut filler according to claim 1, wherein the first tobacco material is shredded into strips each comprising at least a first, a second and a third strip structures, wherein the first strip structure comprises a node from which the second strip structure branches off, the second strip structure comprises a second node from which the third strip structure branches off.

13. A tobacco cut filler according to claim 1 having a filling power of at least 3.5 cubic centimetres per gram at a reference moisture value of 12.5 percent oven volatiles.

14. A smoking article comprising a rod of a tobacco cut filler according to claim 1.

15. A method of making tobacco cut filler comprising:

providing a first tobacco material;

cutting the first tobacco material into strips in accordance with a first cut specification setting at least predetermined first cut width and first cut length, a cut length distribution among the cut strips being at least bimodal.

16. A method according to claim 15, comprising:

providing a second tobacco material;

cutting the second tobacco material separately from the first tobacco material and in accordance with a second cut specification, the second cut specification differing from the first cut specification for at least one of cut length and cut width; and blending the cut first tobacco material and the cut second tobacco material.

17. A method according to claim 15, wherein the first tobacco material is a pre-processed tobacco material.

18. A method according to claim 15, wherein the second tobacco material is a reconstituted tobacco sheet.

19. A method according to claim 15, further comprising conditioning the first tobacco material prior to cutting the first tobacco material.

20. A method according to claim 18, comprising controlling the moisture content of the cut filler by adjusting the moisture content of the first tobacco material.

21. A method according to claim 15, further comprising adjusting the moisture content of the second tobacco material.

* * * * *